US012553328B2

(12) United States Patent
Snyder et al.

(10) Patent No.: US 12,553,328 B2
(45) Date of Patent: Feb. 17, 2026

(54) SAND COLLECTOR FOR ELECTRIC SUBMERSIBLE PUMP

(71) Applicant: Daniel J. Snyder, Edmond, OK (US)

(72) Inventors: Daniel J. Snyder, Edmond, OK (US); Jeremy J. Snyder, Livermore, CA (US)

(73) Assignee: Daniel J. Snyder, Edmond, OK (US)

( * ) Notice: Subject to any disclaimer, the term of this patent is extended or adjusted under 35 U.S.C. 154(b) by 0 days.

(21) Appl. No.: 18/632,536

(22) Filed: Apr. 11, 2024

(65) Prior Publication Data

US 2024/0344432 A1 Oct. 17, 2024

Related U.S. Application Data

(60) Provisional application No. 63/495,402, filed on Apr. 11, 2023.

(51) Int. Cl.

| | |
|---|---|
| ***E21B 43/38*** | (2006.01) |
| ***E21B 27/00*** | (2006.01) |
| ***E21B 34/08*** | (2006.01) |
| ***E21B 43/08*** | (2006.01) |

(Continued)

(52) U.S. Cl.

CPC ..... *E21B 43/38* (2013.01); *E21B 27/00* (2013.01); *E21B 34/08* (2013.01); *E21B 43/08* (2013.01); *E21B 43/128* (2013.01); *E21B 43/35* (2020.05)

(58) Field of Classification Search

CPC ..... E21B 43/35; E21B 43/34; E21B 43/36; E21B 43/38; E21B 43/385; E21B 43/128; E21B 27/00

See application file for complete search history.

(56) References Cited

U.S. PATENT DOCUMENTS

| | | | | |
|---|---|---|---|---|
| 642,483 A | | 1/1900 | Pew | |
| 1,329,171 A | * | 1/1920 | Garry | B01D 29/58 415/121.2 |
| 2,311,963 A | | 2/1943 | Pyle | |

(Continued)

FOREIGN PATENT DOCUMENTS

| | | |
|---|---|---|
| CN | 105134586 B | 8/2017 |
| CN | 206458588 U | 9/2017 |
| CN | 216517937 U | 5/2022 |

OTHER PUBLICATIONS

International Search Report and Written Opinion dated Nov. 29, 2022; (12 pgs).

(Continued)

*Primary Examiner* — George S Gray

(74) *Attorney, Agent, or Firm* — Dunlap Codding, P.C.

(57) ABSTRACT

A sand collector includes a housing and an insert. The insert has a sleeve concentrically disposed in the housing to form an annulus. An upper end of the sleeve is connected to an upper end of the housing so an upper end of the annulus is closed. A lower end of the sleeve is closed to form a collection chamber, and a lower end of the sleeve is spaced from the lower end of the housing so a gap is formed between the lower end of the sleeve and the lower end of the housing. The sleeve has at least one flow port adjacent the upper end thereof to permit the flow of fluid up through the annulus and the sleeve when fluid is flowing upward and to collect sand and other solids in the collection chamber when fluid is flowing downward.

6 Claims, 14 Drawing Sheets

(51) Int. Cl.
*E21B 43/12* (2006.01)
*E21B 43/34* (2006.01)

(56) References Cited

U.S. PATENT DOCUMENTS

| | | | | |
|---|---|---|---|---|
| 2,815,190 | A | 12/1957 | Dawson, Jr. | |
| 3,090,324 | A | 5/1963 | Schmidt | |
| 4,476,925 | A * | 10/1984 | Cox | E21B 43/38 166/105.1 |
| 5,553,669 | A | 9/1996 | Trainer | |
| 6,152,218 | A | 11/2000 | Safargar | |
| 6,216,788 | B1 | 4/2001 | Wilson | |
| 7,008,197 | B2 | 3/2006 | Ford | |
| 7,404,702 | B2 | 7/2008 | Ford | |
| 9,163,483 | B2 | 10/2015 | Ford | |
| 9,181,785 | B2 | 11/2015 | Lawson et al. | |
| 9,441,435 | B2 | 9/2016 | Leitch | |
| 10,082,014 | B2 | 9/2018 | Fielder, III et al. | |
| 10,184,328 | B1 | 1/2019 | Holleman | |
| 10,458,211 | B2 | 10/2019 | Ford | |
| 10,605,064 | B1 | 3/2020 | Raglin | |
| 10,731,446 | B2 | 8/2020 | Stachowiak et al. | |
| 10,760,398 | B2 | 9/2020 | Webber et al. | |
| 10,947,813 | B2 | 3/2021 | Ejim et al. | |
| 11,149,524 | B2 | 10/2021 | Reed et al. | |
| 11,300,121 | B2 | 4/2022 | Correa et al. | |
| 11,371,332 | B2 | 6/2022 | Xiao et al. | |
| 2002/0134554 | A1 | 9/2002 | Schrenkel et al. | |
| 2006/0083646 | A1 | 4/2006 | Ford | |
| 2008/0210417 | A1 | 9/2008 | Ford | |
| 2010/0108150 | A1 | 5/2010 | Ford | |
| 2013/0140032 | A1 | 6/2013 | Ford | |
| 2013/0140247 | A1 | 6/2013 | Ford | |
| 2014/0014358 | A1 * | 1/2014 | Leitch | E21B 43/08 166/105.4 |
| 2016/0177696 | A1 | 6/2016 | Raglin | |
| 2016/0251951 | A1 | 9/2016 | Stachowiak et al. | |
| 2017/0328190 | A1 | 11/2017 | Fielder et al. | |
| 2018/0298736 | A1 | 10/2018 | Bailey et al. | |
| 2020/0173267 | A1 | 6/2020 | Leitch | |
| 2021/0164310 | A1 | 6/2021 | Head et al. | |
| 2021/0180429 | A1 | 6/2021 | Brown et al. | |
| 2022/0049575 | A1 | 2/2022 | Coon et al. | |
| 2022/0331714 | A1 | 10/2022 | Coon et al. | |
| 2023/0048753 | A1 | 2/2023 | Snyder | |

OTHER PUBLICATIONS

International Search Report and Written Opinion dated Jul. 24, 2024; (11 pgs).

* cited by examiner

SAND COLLECTOR FOR ELECTRIC SUBMERSIBLE PUMP

CROSS-REFERENCE TO RELATED APPLICATIONS

This application claims the benefit of U.S. Provisional Application No. 63/495,402, filed Apr. 11, 2023, which is hereby incorporated herein by reference in its entirety.

BACKGROUND

Electric submersible pumps (ESP) are often used when the natural pressure of an oil and gas formation is insufficient to lift the oil to the earth's surface. ESPs operate by admitting fluid from the formation into a tubing string and then lifting the fluid to the surface. To accomplish this, ESPs may have multiple components depending on the environment they are being used—an electric motor and a pump.

With many production systems that use a downhole pump, problems can arise when the pump is shut down after pumping fluid up the production tubing to the surface. On pump shutdown, flow ceases quickly as the fluid levels in the production bore and the annulus equalize. Gravity acting on the sand particles present in the column of fluid above the pump (which could be several thousand feet) causes the sand and any other solids to fall back toward the pump. Due to the complex configuration of the interior features of the ESP, there is no direct path for the sand to pass through the pump; therefore, it settles in and on top of the pump. This can cause damage to the premature wear of the pump and even cause the pump to seize. Such failure of the downhole pump requires work-over involving pull-out and reinstallation of the completion. This is an expensive and time-consuming operation.

To this end, a need exists for an improved sand collector for use with electric submersible pumps to prevent or reduce the number of solids from reentering the pump. The inventive concepts disclosed herein are directed to such an improved sand collector.

DETAILED DESCRIPTION OF EXEMPLARY EMBODIMENTS

Figure 1:
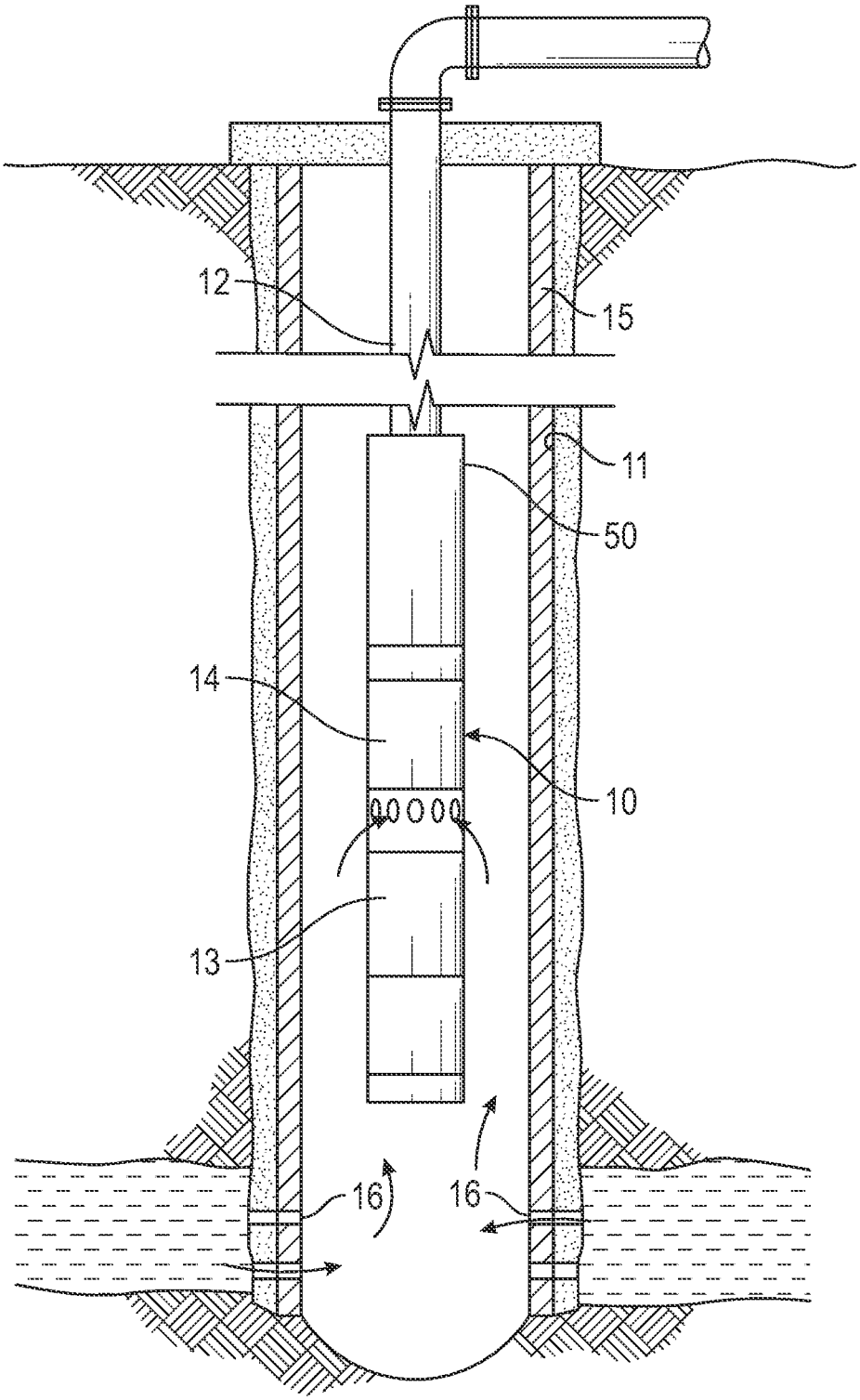
FIG. 1 is a schematic view of an electric submersible pump assembly with a downhole sand collector constructed in accordance with the inventive concepts disclosed herein incorporated with the electric submersible pump.
Figure 2:
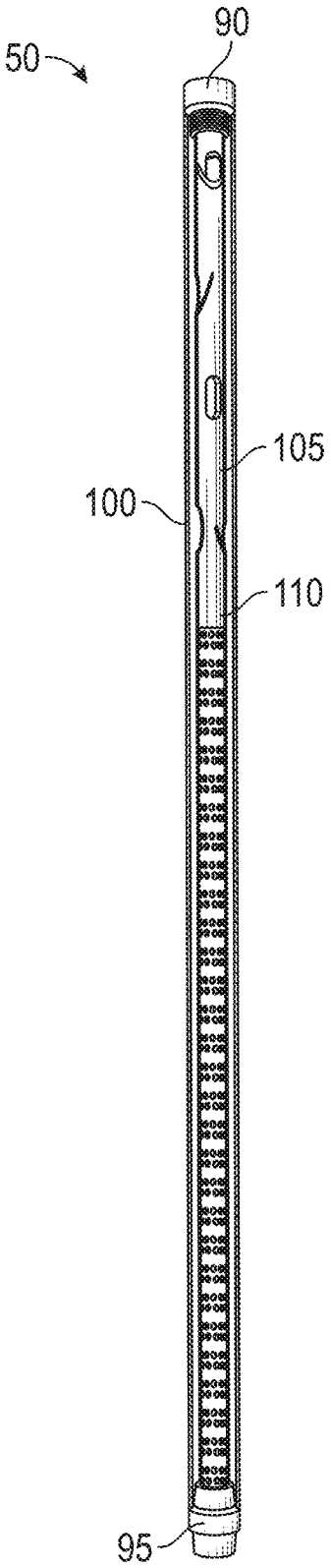
FIG. 2 is a partially cross-sectional, elevational view of the sand collector.
Figure 3:
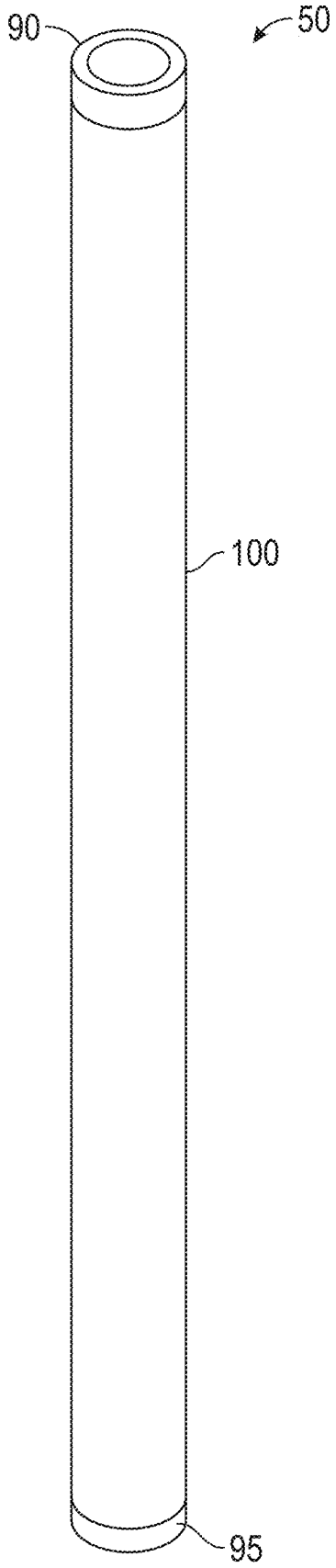
FIG. 3 is a perspective view of the sand collector.
Figure 4:
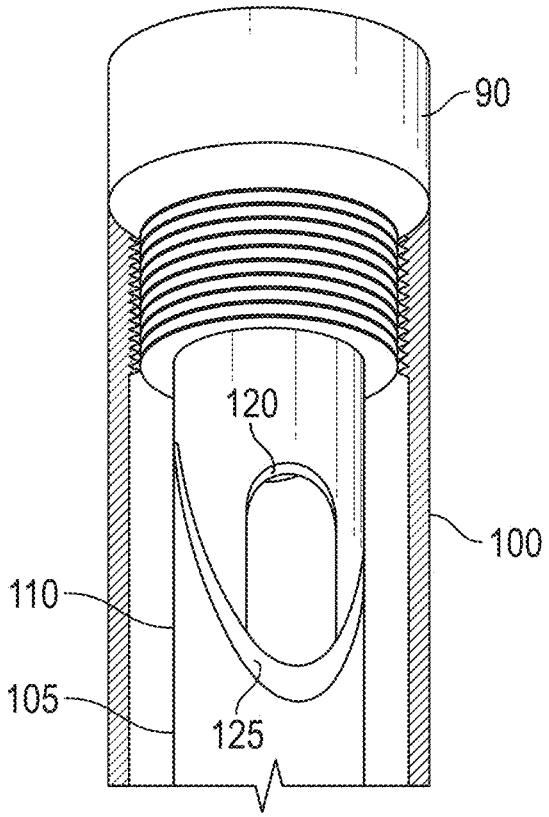
FIG. 4 is a partially cross-sectional, perspective view of an upper end of the sand collector.
Figure 5:
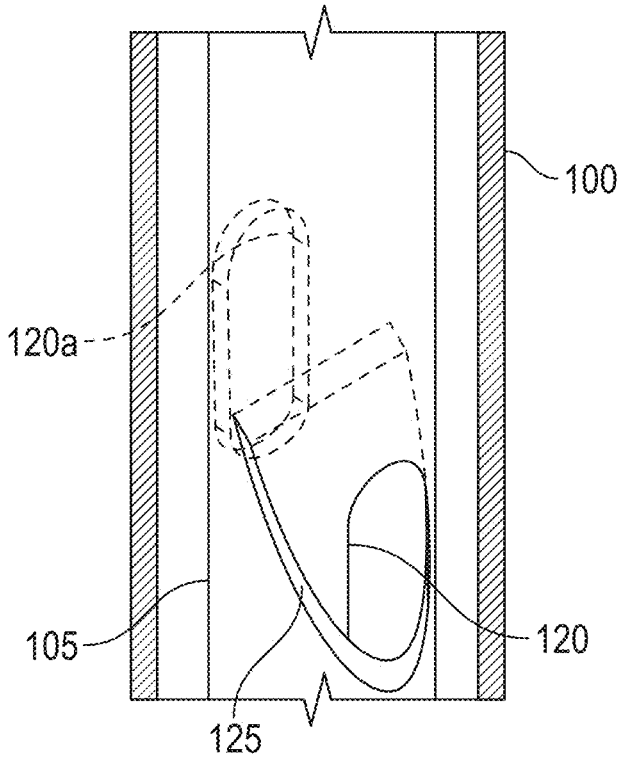
FIG. 5 is a partially cross-sectional view of the upper end of the sand collector.
Figure 6:
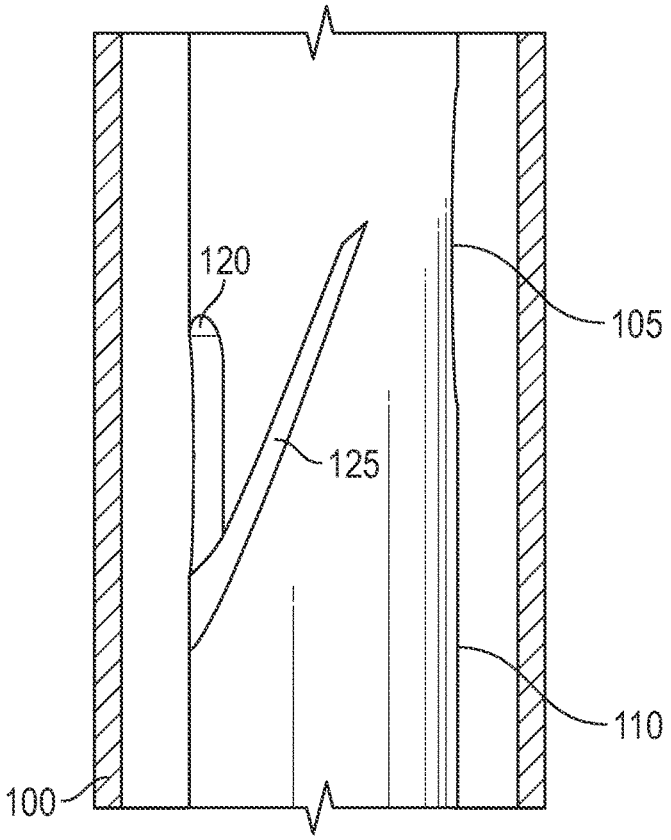
FIG. 6 is a partially cross-sectional, elevational view of a portion of the sand collector illustrating a baffle section.
Figure 7:
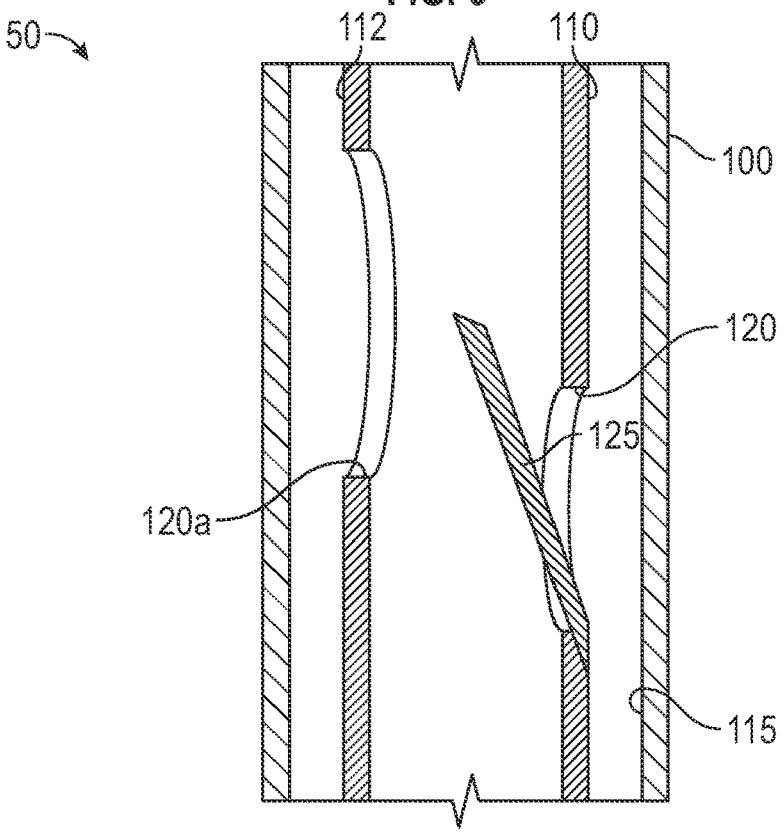
FIG. 7 is a cross-sectional view of the baffle section of the sand collector.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments or being practiced or carried out in various ways. Also, it is to be understood that the phraseology and terminology employed herein are for the purpose of description and should not be regarded as limiting the inventive concepts disclosed and claimed herein in any way.

In the following detailed description of embodiments of the inventive concepts, numerous specific details are set forth to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof are intended to cover a non-exclusive inclusion. For example, a process, method, article, or apparatus that comprises a list of elements is not necessarily limited to only those elements and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof are intended to include not only the exact amount or value they qualify but also some slight deviations therefrom, which may be due to manufacturing tolerances, measurement error, wear and tear, stresses exerted on various parts, and combinations thereof, for example.

Finally, as used herein, any reference to "one embodiment" or "an embodiment" means that a particular element, feature, structure, or characteristic described in connection with the embodiment is included in at least one embodiment. The phrase "in one embodiment" appearing in various places in the specification does not necessarily refer to the same embodiment.

Referring now to the drawings, and more particularly to FIG. 1, an electric submersible pump 10 (the pump assembly 10) is shown in a wellbore 11 of a well. The wellbore 11 may be provided with a casing 15 that may be perforated at one or more positions along its length that form perforations 16 allowing fluids from the surrounding formation to enter the casing 15. The fluids may include liquids and gases.

The pump assembly 10 is secured within a tubing string 12 and functions to elevate fluids, such as hydrocarbons, to the earth's surface. Electric submersible pumps may have multiple components depending on the environment in which they are used. In the illustrated embodiment, the pump assembly 10 includes two principal elements—an electric motor 13 and a pump 14. As shown in FIG. 1, the pump assembly 10 is arranged with the electric motor 13 positioned downhole of the pump 14. To this end, a lower end of the electric motor 13 defines an inlet, and an upper end of the pump 14 defines an outlet. The upper end of the pump 14 is threaded to be connected to an uphole portion of the tubing string 12.

As further stated above, problems can arise when the pump assembly 10 is shut down after a period of pumping fluid up the production tubing to the surface. On shutdown of the pump assembly 10, flow ceases as the fluid levels in the production bore and the annulus equalize. Gravity acting on the sand particles present in the column of fluid above the pump causes the sand and any other solids to fall back toward the pump assembly 10. Due to the complex configuration of the interior features of the pump assembly 10, there is no direct path for the sand to pass through the pump assembly 10; therefore, it settles in and on top of the pump assembly 10. This can cause damage to the premature wear to the pump assembly 10 and even cause the pump assembly 10 to seize.

A sand collector 50 constructed in accordance with inventive concepts disclosed herein is shown incorporated into the tubing string 12. The sand collector 50 is positioned above the pump assembly 10 to collect sand and other solids falling toward the pump assembly 10 and thereby reduce the amount of sand and solids entering the pump assembly 10 when the pump assembly 10 is shut down.

The sand collector 50 may be disposed in line with the tubing string 12. In other words, the sand collector 50 may be coupled between segments of tubing or between the pump assembly 10 and a segment of tubing. During a production phase through the pump assembly 10, the tubing string 12, and the sand collector 50, the produced fluids may entrain sand or other solids. During shutdown, the entrained sand and other solids may fall back toward the pump assembly 10.

Referring now to FIGS. 2-9, the sand collector 50 may include an upper coupling 90, a lower coupling 95, a housing 100, and an insert 105. The upper coupling 90 is adapted to be connected to an upper end of the housing 100 and an upper end of the insert 105. The lower coupling 95 is adapted to be connected to a lower end of the housing 100 and a lower end of the insert 105. The upper coupling 90 and the lower coupling 95 are configured to connect between segments of tubing string, between a segment of tubing string 12 and a downhole tool (for example, the pump assembly 10), or between two downhole tools (not shown).

The housing 100 is a tubular member desirably of the same diameter as the tubular members of the tubing string to which the sand collector 50 is connected. The housing 100 may be of any desired length, such as 30 feet, and may be formed of a single tubular member or multiple tubular members connected end-to-end.

The insert 105 includes various components disposed inside the housing 100. The insert 105 may include a sleeve 110 disposed within the housing 100. The sleeve 110 is generally cylindrical (that is, a hollow cylinder) in shape; however, in some other embodiments, the sleeve 110 may have different forms, for example, a hollow rectangular or hexagonal prism or other shapes, including irregular or non-traditional geometric shapes.

As shown, the sleeve 110 is concentrically disposed within the housing 100. Thus, the outer diameter of the sleeve 110 is less than an inner diameter of the housing 100. The sleeve 110 is configured such that when the sleeve 110 is disposed in the housing 100, an annulus 115 is formed between the housing 100 and the sleeve 110. Therefore, as shown, the outer diameter of the sleeve 110 is smaller than the inside diameter of the housing 100.

The sleeve 110 includes a baffle section 112 and a filter section 114. The baffle section 112 is an upper portion of the sleeve 110 and the filter section 114 is a lower portion of the sleeve 110.

The baffle section 112 may include a plurality of apertures or flow ports 120 disposed around the sleeve 110. The flow ports 120 may be configured as openings extending from an inner surface of the sleeve 110 to an outer surface of the sleeve 110. They, therefore, may provide fluid communication from within the sleeve 110 to the annulus 115 and vice versa. The flow ports 120 may have a circular, oval, square, rectangular, triangular, quadrilateral, other geometric cross-section, or an irregular cross-section. The flow ports 120 may be vertically spaced and rotationally offset (i.e., a helical orientation). In one embodiment, the flow ports 120 may be rotationally spaced approximately 90 degrees and vertically spaced approximately twelve inches. However, the dimensions of the rotational spacing and the vertical spacing may be varied.

The sleeve 110 includes a plurality of baffles 125. The baffles 125 are plate members extending from a lower end of one of the flow ports 120 inwardly and upwardly toward the opposite side of the sleeve 110, so the baffles 125 function to guide settling sand and other solid debris through the flow ports 120 and into the annulus 115 when, for example, the pump assembly 10 is shut down and production fluids fall through the sand collector 50.

The baffles 125 may be set at an angle of about 15 degrees to about 45 degrees from a longitudinal axis of the sleeve 110. In one embodiment, each of the baffles 125 spans approximately 50%-70% of the diameter of the sleeve 110, so a distal end of each of the baffles 125 is spaced from the opposite side of the sleeve 110 to form a passageway between the distal end of the baffle 125 and the opposite side of the sleeve 110. In one embodiment, the baffles 125 may be a separate component coupled to the sleeve 110 by, for example, welding, mechanical fasteners, or other methods known in the art. In other embodiments, the baffles 125 may be integrally formed with the sleeve 110.

The sleeve 110 may include a plurality of secondary apertures or flow ports **120*a* disassociated from the baffles 125. That is, the secondary flow ports 120*a* are not directly associated with one of the baffles 125, but are configured as openings extending from an inner surface of the sleeve 110 to an outer surface of the sleeve 110, and therefore, may provide additional fluid communication from within the sleeve 110 to the annulus 115 and vice versa. The secondary flow ports 120***a* may have a circular, oval, square, rectangular, triangular, quadrilateral, other geometric cross-section, or an irregular cross-section. In one embodiment, the secondary flow ports 120*a* may be paired with one of the flow ports 120 and may be positioned on the opposite side of the sleeve 110. The secondary flow ports 120*a* may be spaced vertically upward from the flow ports 120 so the secondary flow ports 120*a* are positioned adjacent to the upper end of the baffles 125.

Figure 8:
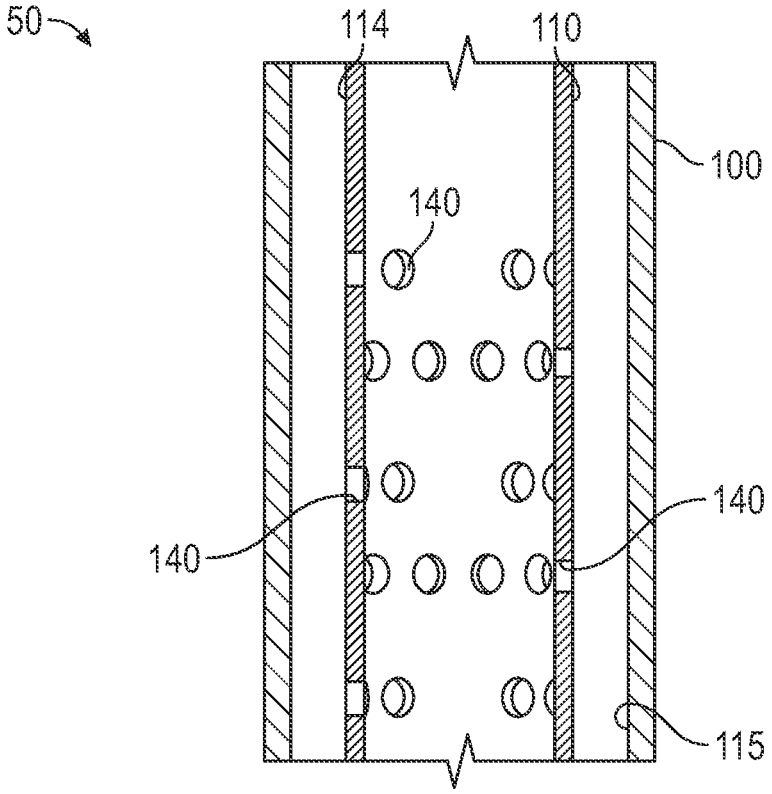
FIG. 8 is a cross-sectional view of a filter section of the sand collector.
Figure 9:
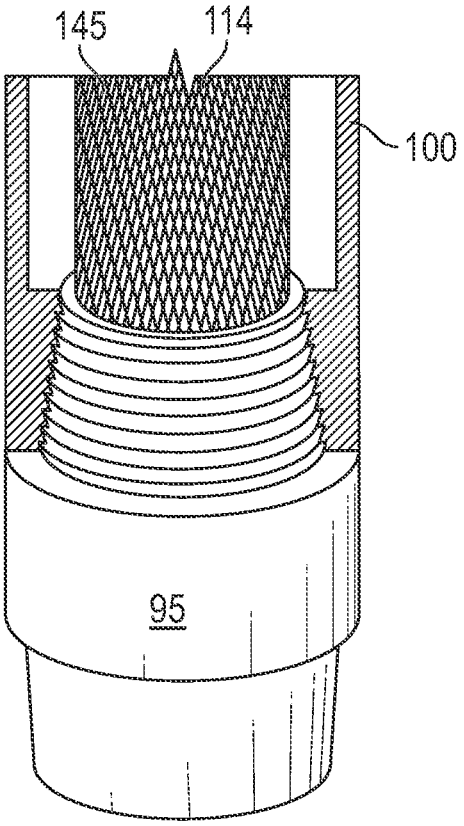
FIG. 9 is a partially cross-sectional view of the filter section of the sand collector.
Figure 10:
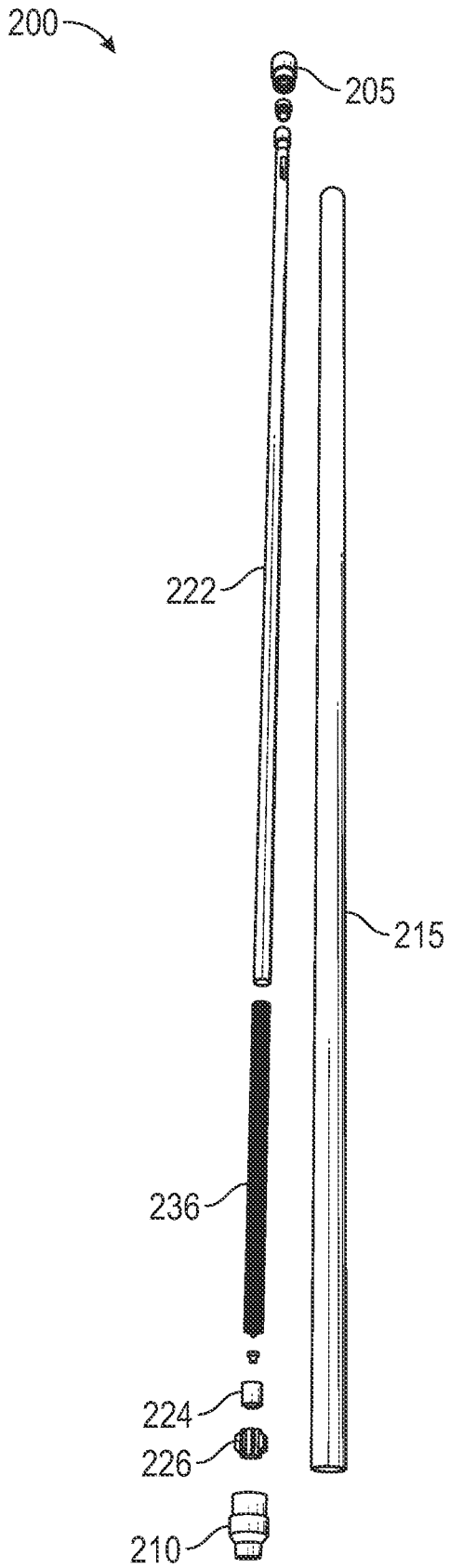
FIG. 10 is an exploded perspective view of another embodiment of a sand collector constructed in accordance with the inventive concepts disclosed herein.

Referring now to FIGS. 8 and 9, in one non-limiting embodiment, the filter section 114 of the sleeve 110 has a plurality of apertures 140 extending through the sleeve 110. The filter section 114 and the baffle section 112 may be formed as a unitary sleeve member. Alternatively, baffle section 112 and the filter section 114 may be formed of separate tubular members adapted to be connected to one another. The lower end of the filter section 114 is adapted to be connected to the lower coupling 95.

A screen, such as a screen 145 illustrated in FIG. 9, may be positioned across the apertures 140 of the filter section 114 on the outside surface or the inside surface of the sleeve 110. The screen 145 is positioned across the apertures 140. The screen 145 may be formed of a wire mesh or wire strainer wrapped and welded in place on a portion of the sleeve. The openings of the screen 145 may be sized to exclude larger sand grain sizes while allowing finer sand grains and fluid to pass through the screen. In one version, the filter section 114 may have a length from about two feet to about 10 feet. However, each dimension may be varied. In one version, the apertures 140 may have a diameter range of approximately 0.3 inches to about 0.5 inches, for example. In addition, any number of apertures 140 may be formed through the sleeve 110, and the apertures 140 may be arranged in various ways.

When fluid is not produced, such as when the pump assembly 10 is shut down, fluids and solids may fall downhole. Fluids and solids falling downhole may enter the sand collector 50 from the upper coupling 90 and be guided to the annulus 115 via the plurality of baffles 125 and the flow ports 120. Because the baffles 125 are rotationally staggered, a significant amount of sand and solids falling downward may be guided into the annulus 115 by at least one of the baffles 125, thereby increasing the amount of sand and solids captured by the sand collector 50.

Once the fluids and the solids enter the annulus 115, the fluids may pass from the annulus 115 through the filter section 114 and through the lower coupling 95, and the solids, including sand, may collect in the annulus 115 between the housing 100 and the sleeve 110.

During the production of a well, the interior of the filter section 114 and the baffle section 112 form a primary flow path, and the apertures 140, the annulus 115, the flow ports 120, and the secondary flow ports 120*a* may form a second flow path as fluid flows in an uphole direction. Fluid flows in the uphole direction through the lower tubing string 12, enters the sand collector 50 through the lower coupling 95, and into the interior of the filter section 114. From there, fluids may travel upward through the filter section 114 and the baffle section 112. As the fluid travels through the baffle section 112, the fluid flows around the baffles 125 in a serpentine path and then through the upper coupling 90.

A portion of the fluid may flow through the apertures 140 of the filter section 114, up through the annulus 115, and enter the baffle section 112 through the flow ports 120 and the secondary fluid flow ports 120*a*. This fluid may lift the solids, including sand, accumulated in the annulus 115. The fluids and the solids flowing upwardly through the annulus 115 pass through the fluid flow ports 120 and the secondary fluid flow ports 120*a* into the baffle section 112 and up into the upper tubing string portion via the upper coupling 90.

Referring now to FIGS. 10-15, another embodiment of a sand collector 200 constructed in accordance with the inventive concepts disclosed herein is shown. The sand collector 200 may be used in the same environments as the sand collector 50, previously described. The sand collector 200 may be used during production operations to protect artificial lift pumps, such as ESPs, and other downhole devices from sand and other particulates entrained in the production fluid or fluids. Like the sand collector 50, the sand collector 200 may be disposed in line with the upper portion of the tubing string 12. In other words, the sand collector 200 may be coupled between segments of tubing. During a production phase through the pump assembly 10, the tubing string 12, and the sand collector 200, the produced fluids may entrain sand or other solids. During shutdown, the entrained sand and other solids may fall back toward the pump assembly 10.

Figure 11:
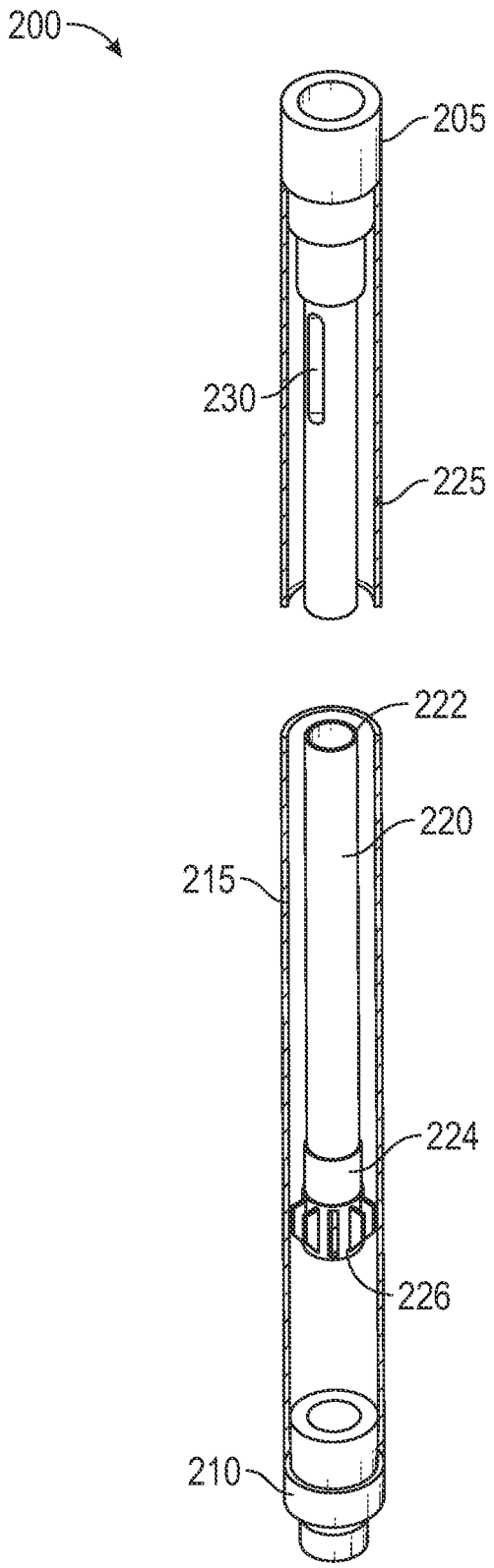
FIG. 11 is a partially cross-sectional, perspective view of the sand collector of FIG. 10.
Figure 12:
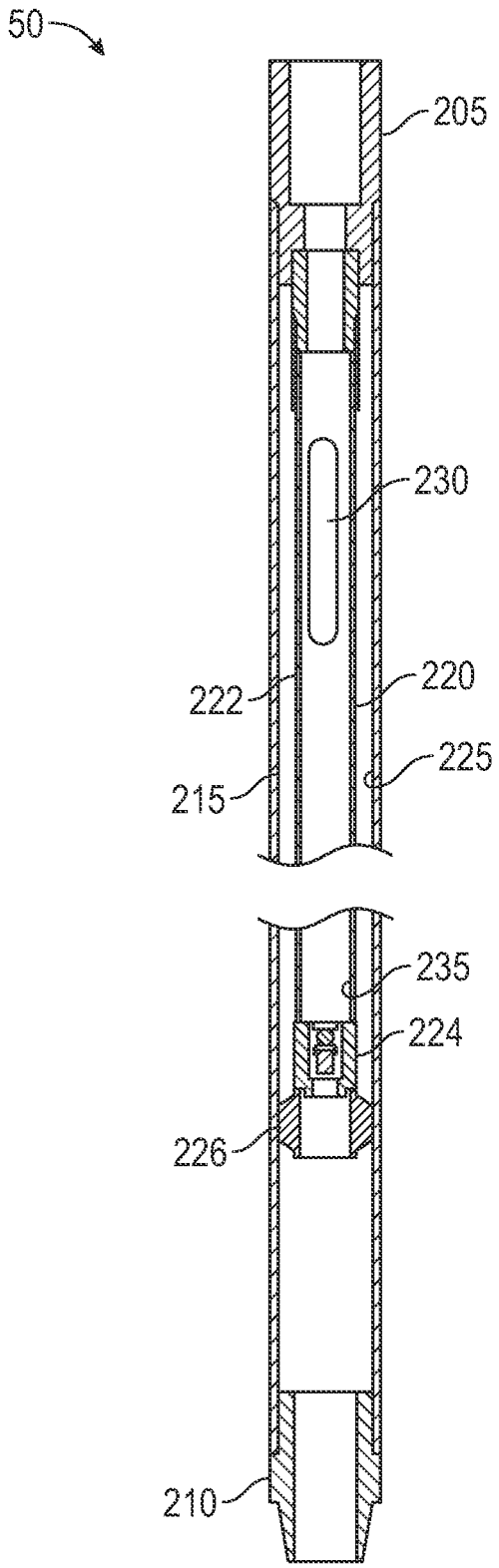
FIG. 12 is a cross-sectional view of the sand collector of FIG. 10.
Figure 13:
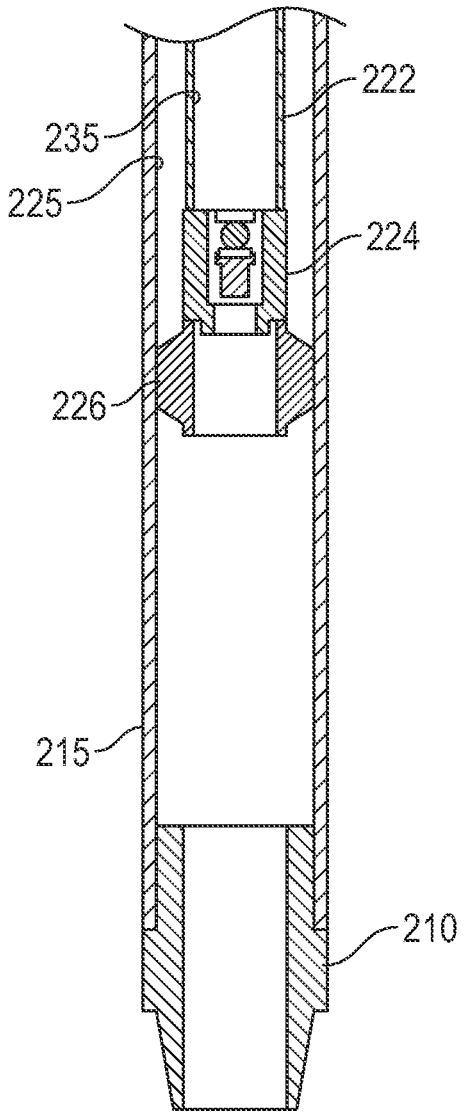
FIG. 13 is an enlarged cross-sectional view of a lower end of the sand collector of FIG. 10.

As shown in FIGS. 11 and 12, the sand collector 200 may include an upper coupling 205, a lower coupling 210, a housing 215, and an insert 220. The upper coupling 205 is adapted to be connected to an upper end of the housing 215 and an upper end of the insert 220. The lower coupling 210 is adapted to be connected to a lower end of the housing 215. The upper coupling 205 and the lower coupling 210 are configured to connect between segments of tubing string 12, between a segment of tubing string 12 and a downhole tool (for example, the pump assembly 10), or between two downhole tools (not shown).

The housing 215 is a tubular member desirably of the same diameter as the tubular members of the tubing string 12 to which the sand collector 200 is connected. The housing 215 may be of any desired length, such as 30 feet, and may be formed of a single tubular member or multiple tubular members connected end-to-end.

The insert 220 includes various components disposed inside the housing 215. The insert 220 may be generally cylindrically shaped (e.g., a hollow cylinder). As shown, the outer diameter of insert 220 is smaller than the inside diameter of the housing 215. In one or more embodiments, the insert 220 is coaxially aligned within the housing 215. An annulus 225 may be formed between the housing 215 and the insert 220. The annulus 225 may receive production fluid flow from a downhole end of the sand collector 200.

In one or more embodiments, the insert 220 includes a sleeve 222, a valve 224, and a lower support member 226. The sleeve 222 is a tubular member with an upper end and a lower end. The upper end of the sleeve 222 is in fluid communication with the upper coupling 205 and may be connected directly to the upper coupling 205 or indirectly via another coupling.

An upper portion of the sleeve 222 may include at least one aperture or flow port 230 and, in some embodiments, two or more flow ports that permit fluid to flow from the annulus 225 to inside the sleeve 222 and uphole through the upper coupling 205 to the uphole portion of the tubing string 12 and vice versa. A lower portion of the sleeve 222 defines a collection chamber 235 that may accumulate sand and particulate matter entrained in the produced fluids when the pump assembly 10 is shut down. In one embodiment, the lower portion of the sleeve 222 may include a filter section 236 formed like the filter section 114 described above.

Figure 15:
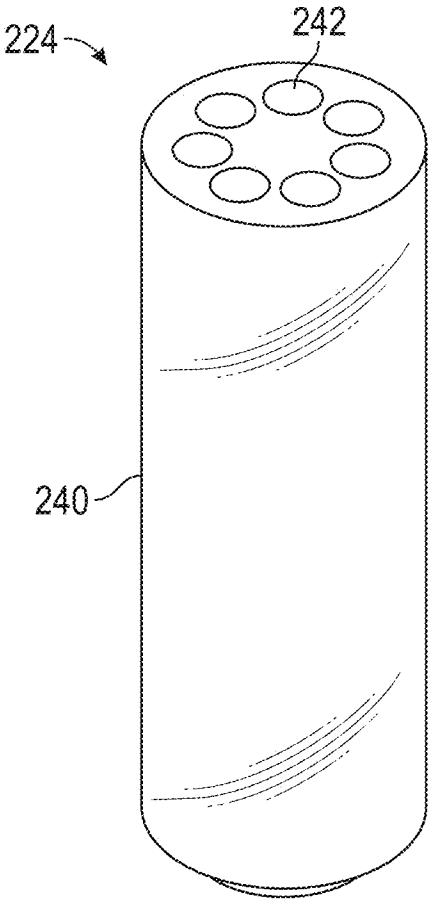
FIG. 15 is a perspective view of the valve of FIG. 14.
Figure 14:
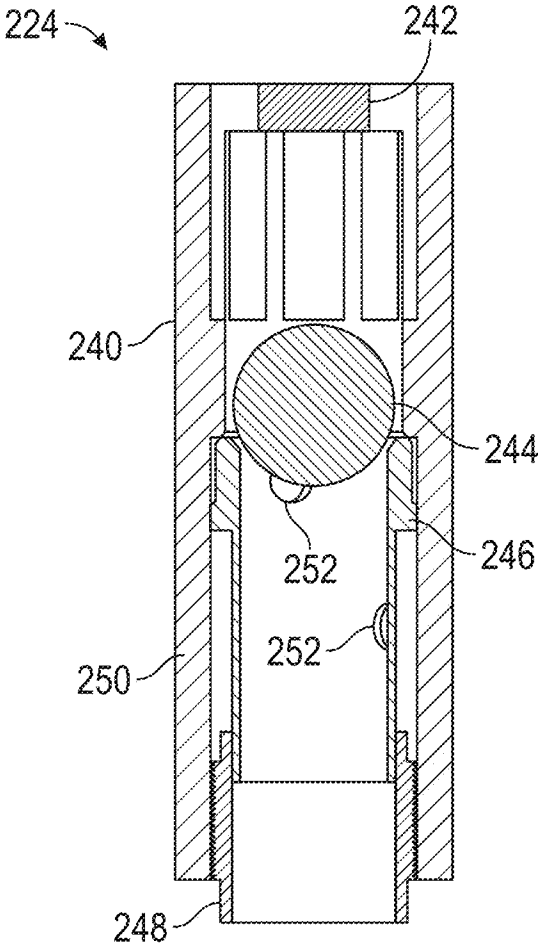
FIG. 14 is a cross-sectional view of a valve shown in a closed position.

Referring now to FIGS. 14 and 15, the valve 224 is connected to the lower end of the sleeve 222. The valve 224 is a one-way valve and may be constructed in various forms. In one embodiment, the valve 224 includes a body 240 with a plurality of openings 242 at an upper end. A valve member 244, such as a ball, is inserted into the body below the openings 242. A valve seat 246 is positioned below the valve member 244. The valve seat 246 is retained in the body 240 with a retainer 248. The valve seat 246 may be slidable between a sealed position (FIG. 14) and a non-seal position (not shown). A wave spring 250 supports the valve seat 246 in the sealed position. The valve seat 246 may have a plurality of apertures 252 that permit the passage of fluid pass valve member 244, and the valve seat 246 should the weight of accumulated fluid, sand, and debris exceed a predetermined amount and cause the wave spring 250 to compress.

When the pump assembly 10 is activated, the valve member 244 moves to an open position wherein the valve member 244 is unseated from the valve seat 246 to permit the flow of fluid up through the valve 224. When the pump assembly 10 is deactivated, the valve member 244 moves to a closed position, and sand and other solids collect in the collection chamber 235 of the sleeve 222.

The support member 226, such as a centralizer, may be connected to the lower end of the valve 224 to support the lower end of the insert 220 within the housing 215 while permitting fluid flow up through the insert 220 when the valve 224 is in the open position, as well as through the annulus 225.

When the pump assembly 10 is activated to cause production fluids to flow upwards through the tubing string 12, fluid flows through the sand collector 200 by passing through the lower coupling 210. A portion of the production fluids pumped by the pump assembly 10 flows through the support member 226, the valve 224, and the sleeve 222. Another portion of the production fluids flows through the annulus 225 between housing 215 and the insert 220 and then through the flow ports 230. All the production fluids proceed uphole through the upper coupling 205 and into the tubing string 12.

If the sleeve 222 includes the filter section 236, a portion of the production fluids pumped by the pump assembly 10 flows through the filter section 236, the support member 226, the valve 224, and the sleeve 222.

When the pump assembly 10 is deactivated so that fluid is no longer being pumped upwards through tubing string 12, the production fluids, including sand or solids in the fluids, travel downwardly under the force of gravity. The downward movement of the production fluids causes the valve 224 to move to the closed position, allowing sand and particulate matter in the production fluids to accumulate in the collection chamber 235 of the sleeve 222. Other fluids may pass outwardly through the flow ports 230 and down the annulus 225. If the sleeve 222 includes the filter section 236, other fluids may also pass from the sleeve 222 through the filter section 236.

When the pump assembly 10 is reactivated, production fluid is caused to flow upwards through the tubing string 12. This upward flow of fluid causes a portion of the fluid to pass through the annulus 225 and into the sleeve 222 via the flow ports 230 to carry a portion of the sand and solids accumulated in the collection chamber 235. The upward flow of fluid also causes the valve 224 to move to the open position and allows fluid to lift a portion of the sand and solids accumulated in the collection chamber 235. If the sleeve 222 includes the filter section 236, a portion of the fluid may also pass into the sleeve 222 via the filter section 236 The sands and solids are entrained in the flow upwards through the sand collector 200 and into the tubing string 12. Therefore, the accumulated sands and solids are purged from the sand collector 200 during the production phase.

Figure 16:
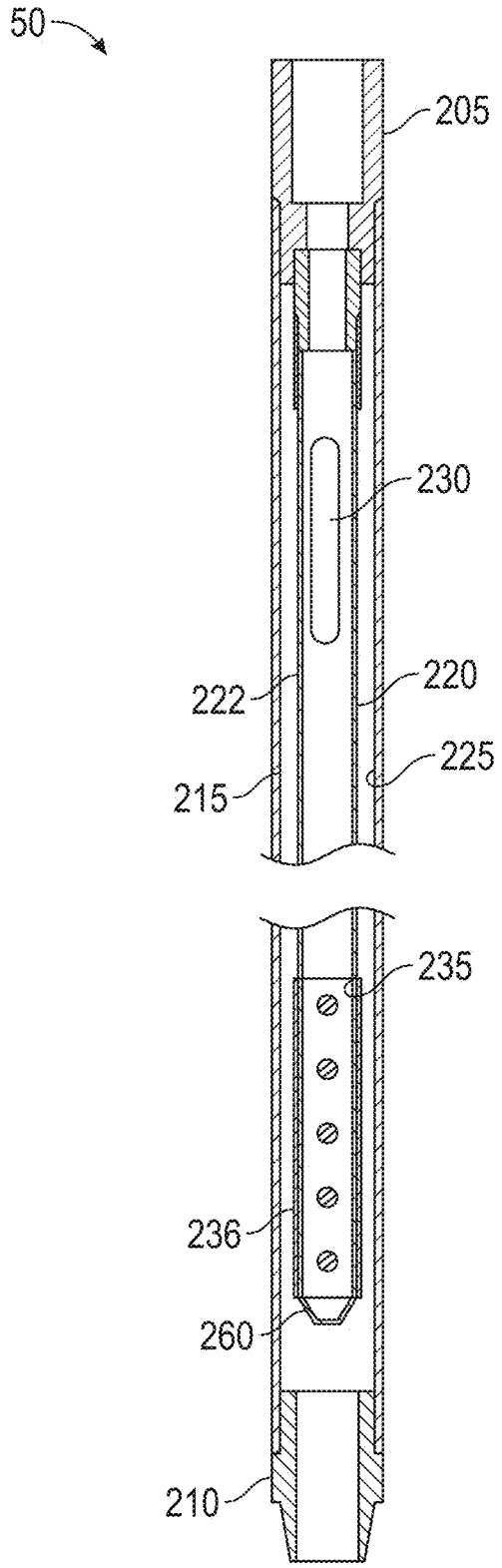
FIG. 16 is a cross-sectional view of another embodiment of a sand collector constructed in accordance with the inventive concepts disclosed herein.
Figure 17:
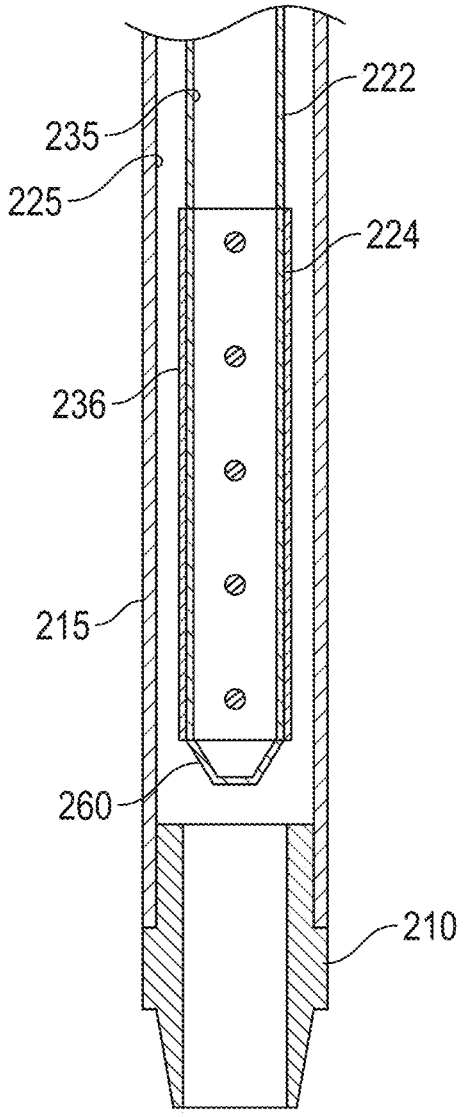
FIG. 17 is an enlarged cross-sectional view of a lower end of the sand collector of FIG. 16.

In another embodiment illustrated in FIGS. 16 and 17, the valve 224 may be omitted and replaced with a plug or cap 260. In this instance, the filter section 236 allows fluid to pass through the insert 220 when the pump assembly 10 is deactivated while allowing sand and particulate matter to accumulate in the collection chamber 235. When the pump assembly 10 is reactivated, the upward flow of fluid causes a portion of the fluid to pass through the filter section 236 and into the sleeve 222 to lift the sand and solids accumulated in the collection chamber 235. The sands and solids are entrained in the flow upwards through the sand collector 200 and into the tubing string 12. Therefore, the accumulated sand and solids are purged from the sand collector 200 during the production phase.

Figure 18:
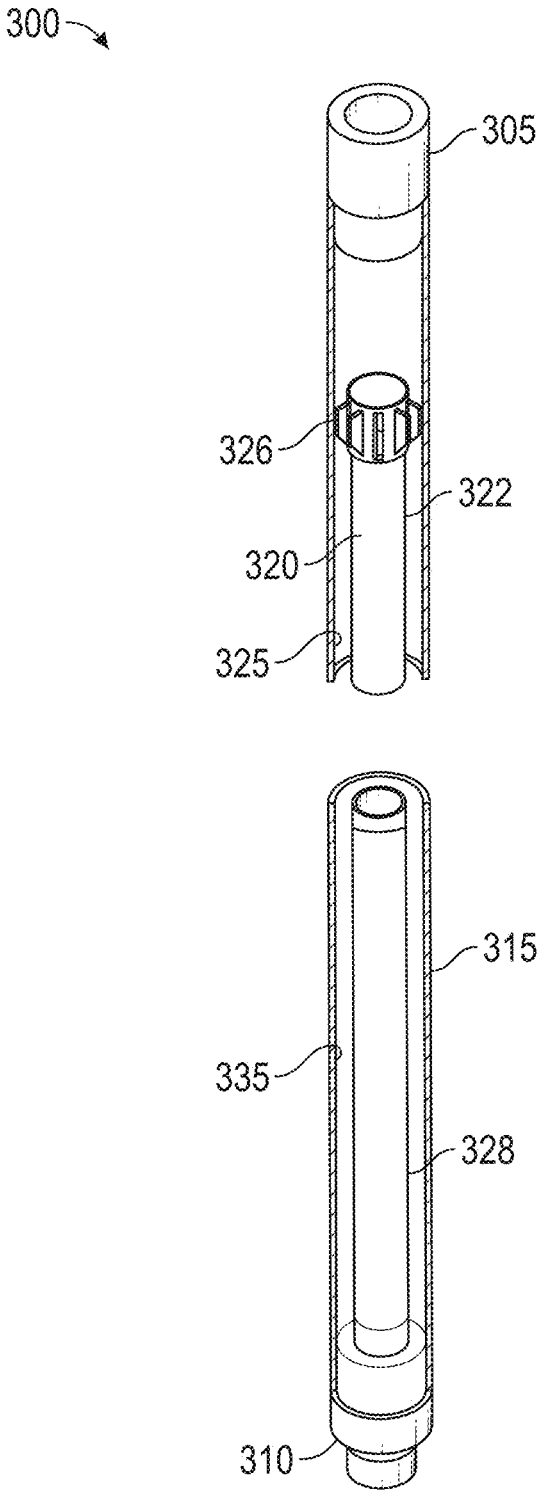
FIG. 18 is a partially cross-sectional, perspective view of another embodiment of a sand collector constructed in accordance with the inventive concepts disclosed herein.
Figure 19:
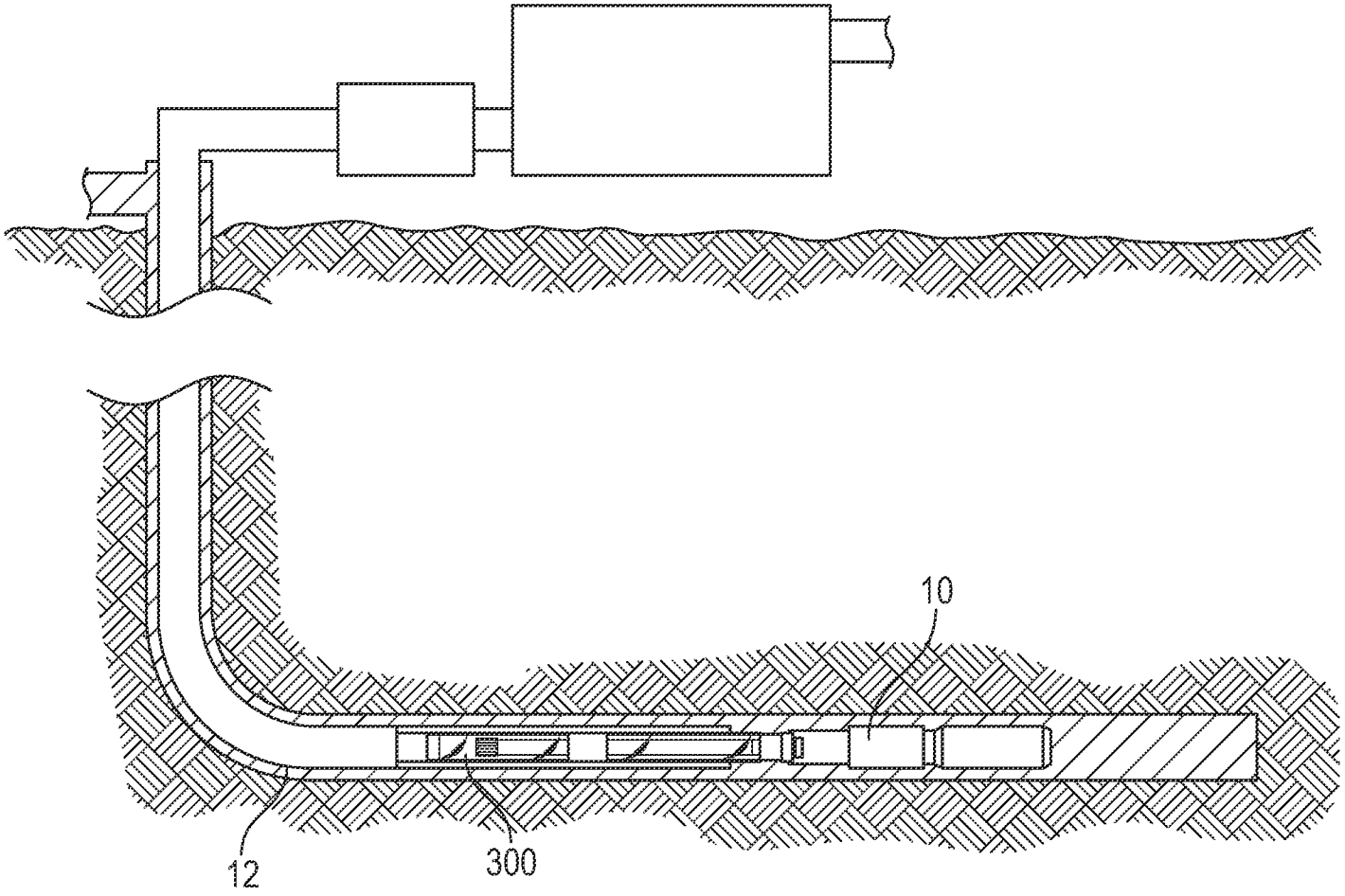
FIG. 19 is a schematic view of the sand collector of FIG. 18 shown positioned in a horizontal leg of a horizontal well.

Referring now to FIGS. 18 and 19, another embodiment of a sand collector 300 constructed in accordance with the inventive concepts disclosed herein is shown. The sand collector 300 may be best suited for use in a curved section or a lateral section of a horizontal well (FIG. 19), where gravity forces sand and solids to one side (a lower side) of the tubing string. During completions or production operations, the sand collector 300 may protect artificial lift pumps, such as ESPs, and other downhole devices from sand and other particulates entrained in the production fluid or fluids. Like the sand collectors 50 and 200, the sand collector 300 may be disposed in line with the tubing string 12. In other words, the sand collector 300 may be coupled between segments of tubing. During a production phase through the pump assembly 10, the tubing string 12, and the sand collector 300, the produced fluids may entrain sand or other solids. During a shutdown phase, the entrained sand and other solids may fall back toward the pump assembly 10.

As shown in FIG. 18, the sand collector 300 may include an upper coupling 305, a lower coupling 310, a housing 315, and an insert 320. The upper coupling 305 is adapted to be connected to an upper end of the housing 315 and an upper end of the insert 320. The lower coupling 310 is adapted to be connected to a lower end of the housing 315. The upper coupling 305 and the lower coupling 310 are configured to connect between segments of tubing string 12, between a segment of tubing string 12 and a downhole tool (for example, the pump assembly 10), or between two downhole tools (not shown).

The housing 315 is a tubular member. The housing 315 may have an outer diameter greater than the outer diameter of the tubular members of the tubing string 12 to which the sand collector 300 is connected. For example, if the outer diameter of the tubular member is 2.875 inches, the outer diameter of the housing may be 4.5 inches. However, the diameter may vary. The housing 315 may be of any desired length, such as 30 feet, and may be formed of a single tubular member or multiple tubular members connected end-to-end.

The insert 320 includes various components disposed inside the housing 315. The insert 320 may be generally cylindrically shaped (e.g., hollow cylinder). As shown, the outer diameter of insert 320 is smaller than the inside diameter of the housing 315. In one or more embodiments, the insert 320 is coaxially aligned within the housing 315.

An annulus 325 may be formed between the housing 315 and the insert 320. As described below, the annulus 325 may form a collection chamber 335 that may accumulate sand and particulate matter entrained in the produced fluids when the pump assembly 10 is shut down.

The insert 320 includes a sleeve 322 and an upper support member 326. The sleeve 322 is a tubular member with an upper and lower end. The lower end of the sleeve 322 is in fluid communication with the lower coupling 310 and may be connected directly to the lower coupling 310 or indirectly via another coupling.

The upper end of the sleeve 320 has a length, so the upper end of the sleeve 320 is spaced from the upper coupling 305. The support member 326, such as a centralizer, may be connected to the upper end of the sleeve 322 to support the upper end of the insert 320 within the housing 315, with the support member 324 spaced from the upper coupling 305 to form a gap.

The lower portion of the sleeve 322 may include a filter section 328, which is formed like the filter section 114 described above.

When the pump assembly 10 is activated to cause production fluids to flow upwards through the tubing string 12, fluid flows through the sand collector 300 by passing through the lower coupling 310, the sleeve 322, and the support member 326. The production fluids from the support member 326 travel across the gap between the insert 320 and the upper coupling 305. All the production fluids proceed uphole through the upper coupling 305 and into the tubing string 12.

When the pump assembly 10 is deactivated so that fluid is no longer being pumped upwards through tubing string 12, the production fluids, including sand or solids in the fluids, travel downwardly under the force of gravity. The downward movement of the production fluids causes sand and particulate matter to fall downward at the gap and accumulate in the lower side of the collection chamber 335 formed between housing 315 and the insert 320. Other fluids may pass downward through the sleeve 322 and the apertures of the filter section 328.

When the pump assembly 10 is reactivated, production fluid is caused to flow upwards through the tubing string 12. This upward flow of fluid causes a portion of the fluid to pass through the filter section 328 and into the annulus 325 to carry the sand and solids accumulated in the collection chamber 335. The upward flow of fluid lifts the sand and solids accumulated in the collection chamber 335. The sands and solids are entrained in the flow upwards through the sand collector 300 and into the tubing string 12. Therefore, the accumulated sand and solids are purged from the sand collector 300 during the production phase.

Although the presently disclosed inventive concepts have been described in conjunction with the specific language set forth herein, many alternatives, modifications, and variations will be apparent to those skilled in the art. Accordingly, it is intended to embrace all such alternatives, modifications, and variations that fall within the spirit and broad scope of the presently disclosed inventive concepts. Changes may be made in the construction and the operation of the various components, elements, and assemblies described herein, without departing from the spirit and scope of the presently disclosed inventive concepts.

What is claimed is:

1. An electric submersible pump assembly, comprising:

a tubing string positioned in a well bore, the tubing string having an upper portion and a lower portion;

an electric submersible pump positioned in the lower portion of the tubing string;

a sand collector incorporated as a portion of the tubing string between the upper portion and the lower portion so the sand collector is positioned uphole of the electric submersible pump, the sand collector comprising:

a housing having an upper end, a lower end, and a sidewall extending between the upper end and the lower end; and an insert having a sleeve concentrically disposed in the housing to form an annulus between the housing and the sleeve, the sleeve having an upper end, a lower end, and a sidewall extending between the upper end and the lower end, the upper end of the sleeve connected to the upper end of the housing so an upper end of the annulus is closed, the lower end of the sleeve being closed to form a collection chamber and the lower end of the sleeve being spaced from the lower end of the housing so a gap is formed between the lower end of the sleeve and the lower end of the housing, the sleeve having at least one flow port extending through the sidewall adjacent the upper end thereof to permit the flow of fluid up through the annulus and the sleeve when fluid is flowing upward and to collect sand and other solids in the collection chamber when fluid is flowing downward, wherein the sleeve has a filter section, the filter section being a lower portion of the sleeve, the filter section having at least one aperture extending through the sleeve.

2. The electric submersible pump assembly of claim 1, wherein the insert has a valve connected to the lower end of the sleeve, the valve cooperating with the sleeve to form the collection chamber, the valve movable between an open position to permit the flow of fluid up through the valve and a closed position to collect sand and other solids in the collection chamber.

3. The electric submersible pump assembly of claim 2, wherein the valve comprises:

a body with a plurality of openings at an upper end;

a valve member inserted into the body below the openings; and a valve seat positioned below the valve member, wherein the valve member is movable between a sealed position and a non-sealed position.

4. The electric submersible pump assembly of claim 3, wherein the valve further comprises a spring to urge the valve seat in the sealed position.

5. The electric submersible pump assembly of claim 1, wherein the insert has a cap connected to the lower end of the sleeve, the cap closing the lower end of the sleeve and cooperating with the sleeve to form the collection chamber.

6. The electric submersible pump assembly of claim 5, wherein the filter section further comprises a screen positioned across the at least one aperture of the filter section of the sleeve.

* * * * *